US005441096A

United States Patent [19]

Wick

[11] Patent Number: 5,441,096

[45] Date of Patent: Aug. 15, 1995

[54] TWO-PIECE CORE MASK

[75] Inventor: Gary L. Wick, Wind Lake, Wis.

[73] Assignee: Briggs & Stratton Corporation, Wauwatosa, Wis.

[21] Appl. No.: 189,055

[22] Filed: Jan. 31, 1994

[51] Int. Cl.[6] ..... B22D 33/04

[52] U.S. Cl. ..... 164/340; 164/137

[58] Field of Search ..... 164/339, 340, 30, 397, 164/137; 249/177, 63, 142; 425/468, 182, 137

[56] References Cited

U.S. PATENT DOCUMENTS

| | | | |
|---|---|---|---|
| 3,664,408 | 5/1972 | Eibe | 164/241 |
| 3,730,253 | 5/1973 | Bührer et al. | 164/241 |
| 4,199,020 | 4/1980 | Bührer | 164/146 |
| 4,724,886 | 2/1988 | Sjodahl | 164/4.1 |
| 4,757,857 | 7/1988 | Henkel | 164/137 |
| 4,848,440 | 7/1989 | Hunter | 164/253 |
| 5,076,342 | 12/1991 | Johansen | 164/137 |

*Primary Examiner*—Kuang Y. Lin
*Assistant Examiner*—Randolph S. Herrick
*Attorney, Agent, or Firm*—Michael, Best & Friedrich

[57] ABSTRACT

A core mask assembly is provided for depositing a core within an internal pattern formed by the joinder of first and second cooperating mold sections. The core mask assembly includes a reciprocal carrying ram and a base member interconnected to the ram. A face plate having a pattern for receipt of the core is removably connected to the base member. A unique mounting and alignment arrangement permits easy removal and replacement of the face plate when desired.

28 Claims, 4 Drawing Sheets

FIG. 2
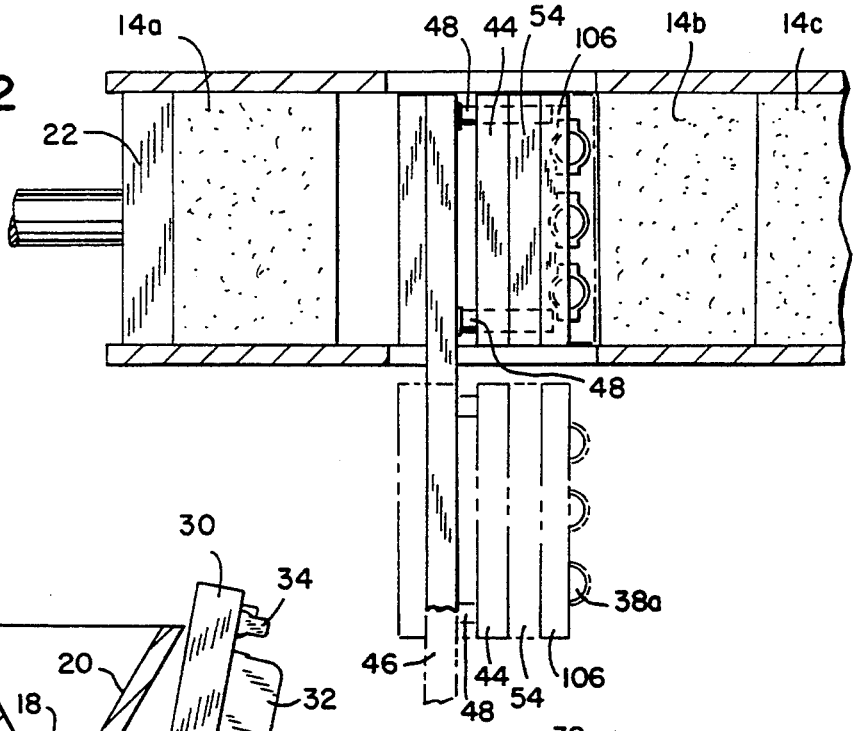
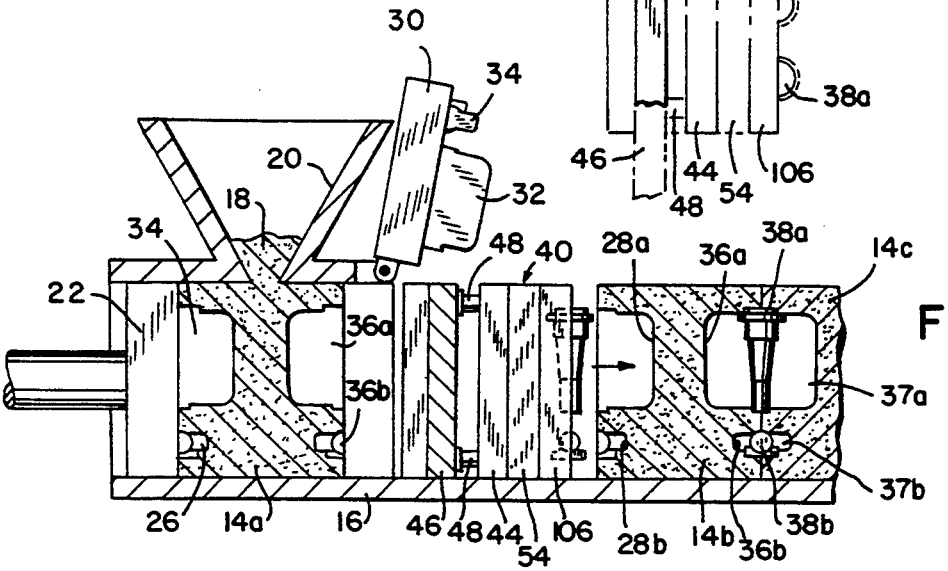
FIG. 3
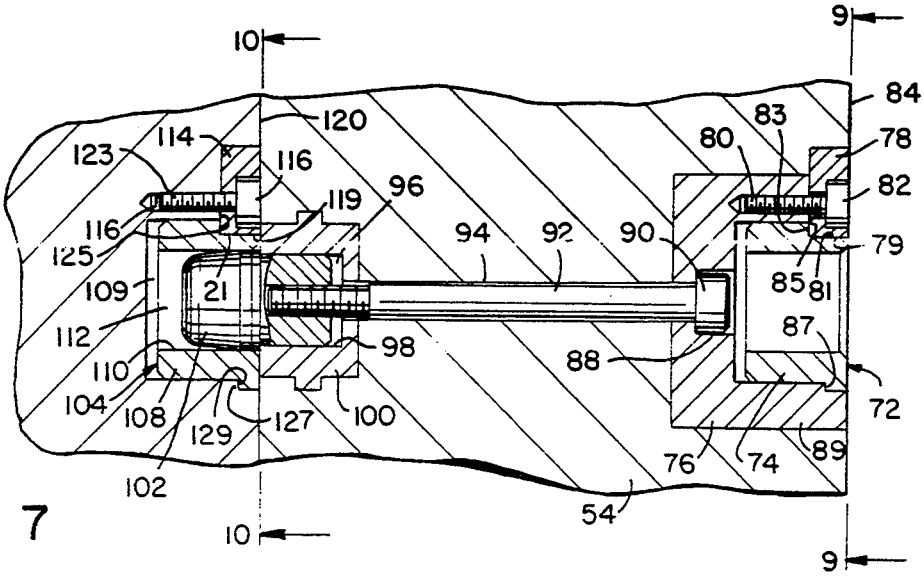
FIG. 7

TWO-PIECE CORE MASK

BACKGROUND AND SUMMARY OF THE INVENTION

This invention relates to a mold forming apparatus and, in particular, to a core mask assembly for depositing a core within an internal cavity of a mold.

In foundry operations, a foundry production line system is used to mold a desired end product. The production line system includes a sand mold making machine for forming cooperative mold sections, a conveyor, a mold pouring station where the molten metal is dispensed, and a system control unit. The mold making machine includes mold dies which are of a convex shape corresponding to a half configuration of the desired end product. The mold dies are used to form mold sections in sand which are combined to form a mold in which the molten metal is dispensed.

When a cavity is needed within the desired end product, a core must be deposited within the cooperating mold sections of the mold. When molten metal is poured into the mold, the core forms a cavity in the desired end product.

In order to deposit a core between cooperating mold sections, a core mask assembly is used. Heretofore, core mask assemblies consisted of a face plate and a reciprocal ram carrying the face plate. The face plate includes a pattern corresponding to the shape of the core to be deposited between the cooperating mold sections. After a core is received within the pattern in the face plate, the reciprocal ram inserts the face plate between the cooperating mold sections and deposits the core therebetween. The reciprocal ram then withdraws the face plate from between the cooperating mold sections and the mold sections are combined with the core therein to form the mold.

The typical core mask assembly also includes a vacuum generating system. The vacuum generating system maintains the core within the pattern of the face plate as the core mask assembly is positioned between the first and second cooperating mold sections. When the core mask assembly is positioned between the cooperating mold sections, the vacuum generating system releases the core from the pattern of the face plate in order to deposit the core.

Previous face plates were constructed as a single unit. The units were heavy and required powered equipment to lift and many man hours to replace. In situations which require frequent changing of the pattern for the core, the extensive downtime of the foundry's production line system can be quite expensive.

Therefore, it is a primary objective of this invention to provide a core mask assembly wherein the face plate may be readily replaced.

It is a further objective of this invention to provide a core mask assembly wherein the face plate may be simply and quickly aligned on the reciprocal carrying ram.

It is an additional objective of this invention to provide a core mask assembly having a face plate that may be used in conjunction with present foundry production line systems.

In accordance with the invention, a core mask assembly is provided for depositing a core within an internal cavity formed in cooperating mold sections. The core mask assembly includes a reciprocal carrying ram and a base member connected thereto. A face plate, including a pattern for receipt of the core, is removably connected to the base member. Thus, if a different pattern for the core is required, only the face plate needs to be changed.

In accordance with the present invention, the face plate is mounted to the base member in such a manner that it may be easily removed from the base member and replaced.

The core mask assembly is also provided with a means for aligning the face plate on the base member. The means for aligning the face plate includes a pin assembly interconnected to the base member. A portion of the pin assembly extends from the base member for insertion into a pin receipt assembly removably connected to the face plate.

When aligning the face plate, the pin receipt assembly is placed over the portion of the pin assembly extending from the base member, thereby aligning the face plate on the base member. The pin assembly and the pin receipt assembly are easily removable from the base member and the face plate respectively. As a result, the pin assembly and the pin receipt assembly may be easily replaced when they become worn or damaged to insure the proper alignment of the face plate on the base member.

BRIEF DESCRIPTION OF THE DRAWINGS

FIG. 2 is a top plan view, partially in section, showing the operation of the core mask assembly of this invention.

FIG. 3 is a portion of the foundry production line system of FIG. 1, partially in section, showing the core mask assembly of this invention.

FIG. 7 is a sectional view of the alignment arrangement for the core mask assembly of this invention shown in FIG. 4.

DETAILED DESCRIPTION OF THE PREFERRED EMBODIMENT

Figure 1:
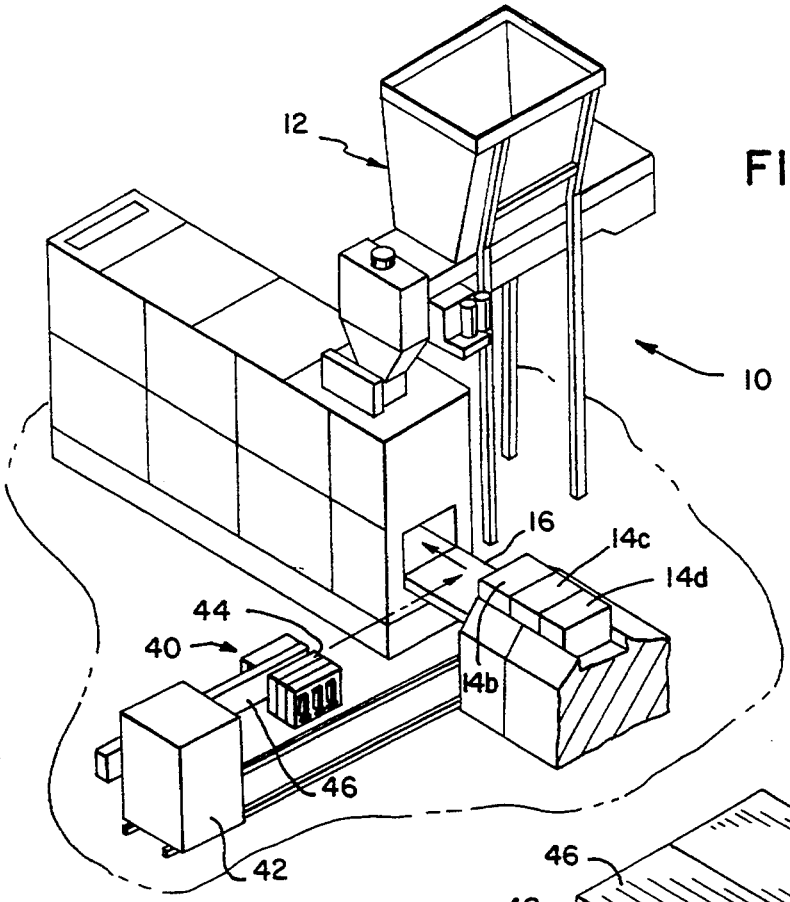
FIG. 1 is an isometric view of a portion of a foundry production line system incorporating the core mask assembly of this invention.

FIG. 1 shows a foundry production line system, generally designated by the reference numeral 10. The foundry production line system 10 includes a sand mold making machine 12 for forming cooperating mold sections 14*a*, 14*b*, 14*c*, 14*d*, etc. (see FIGS. 1–3). Each cooperating mold section 14*a*, 14*b*, 14*c*, 14*d* is formed by the mold making machine 12, and conveyed along a predetermined path by a conveyor 16 to a mold pouring station. The mold making machine 12 is a commercially available sand mold machine of the type utilized by ferrous foundries.

Referring to FIG. 3, sand 18 is poured into bin 20 of mold machine 12. The sand 18 is compressed to form mold section 14a by reciprocal ram 22 carrying a pair of mold dies 24 and 26 and by an upward pivotable gate 30 carrying matching mold dies 32 and 34. Mold dies 24 and 26 press first mold cavities 28*a*, 28*b* into an interior portion of a trailing face of a mold section. Mold dies 32 and 34 press corresponding second mold cavities 36*a*, 36*b* into an interior portion of a leading face of the same mold section. The mold dies 24, 26, and 32, 34 are convex in shape each corresponding to one half of the desired end product.

Each mold section configuration 14*a*, 14*b*, 14*c*, 14*d* includes first mold cavities 28*a*, 28*b* on its trailing face and second mold cavities 36*a*, 36*b* on its leading face with compressed sand between the first and second mold cavities. The mold cavities 36*a*, 36*b* on the leading face of one mold section 14*b* comes in contact with previously formed mold cavities 28*a*, 28*b* on a trailing face of the next adjacent mold section 14*c* as the mold sections are advanced from the mold making machine 12 by the force of the ram 22. The mold cavities 28*a*, 28*b* and 36*a*, 36*b* cooperate to form whole patterns 37*a*, 37*b* in the interior of each cooperating pair of mold sections 14*b*, 14*c*. The patterns 37*a*, 37*b*, are of the shape of the desired end product.

Figure 4:
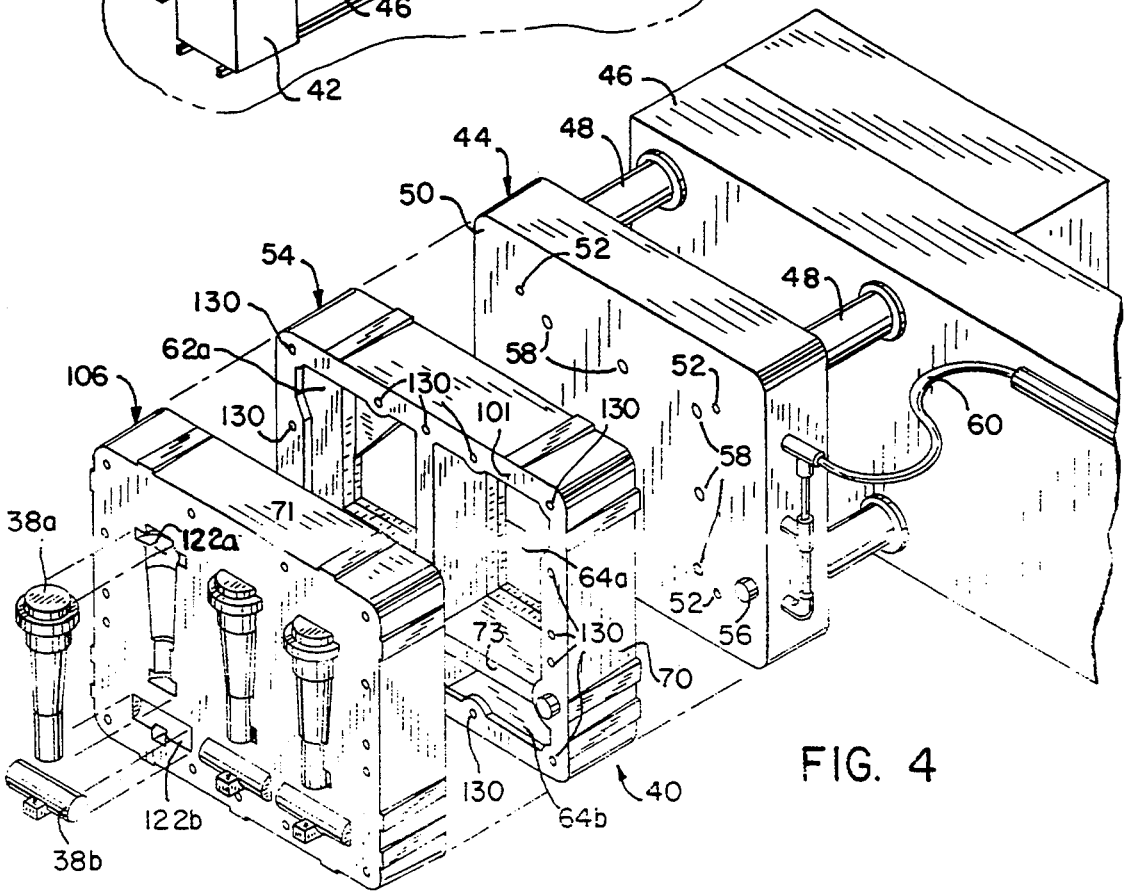
FIG. 4 is an exploded isometric view of the core mask assembly of this invention.

In order to place cores 38*a*, 38*b* within the patterns 37*a*, 37*b* in the interior of each cooperating pair of mold sections, a core mask assembly 40, shown in FIG. 4, is provided. Core mask assembly 40 includes a base member 54 together with a removable and interchangeable face plate 106 as will hereinafter be described.

As best seen in FIG. 1, a positioning cart 42 positions core mask assembly 40 in and out of the path of mold section 14*a* on conveyor 16. Core mask assembly 40 includes a reciprocal carrying ram 44 connected by pistons 48, see FIGS. 2 and 4, to an arm 46 extending from positioning cart 42.

Referring to FIG. 4, reciprocal carrying ram 44 includes a front face 50 having a plurality of bolt passages 52 for use in interconnecting a base member 54 to the reciprocal carrying ram 44. A plurality of pins 56 extend from the front face 50 of reciprocal carrying ram 44 for aligning base member 54 with face 50 of ram 44. Vacuum apertures 58 in front face 50 are operatively connected to a conventional vacuum generating system by tube 60.

Figure 8:
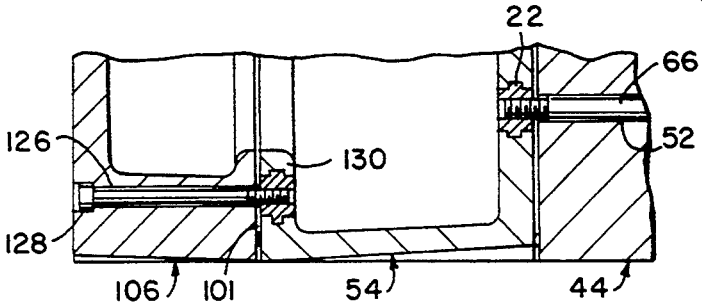
FIG. 8 is a sectional view of the mounting arrangement for the core mask assembly of this invention shown in FIG. 4.

Base member 54 includes a rectangular frame 70 and a pair of cross braces 71 and 73 which support outer frame 70 and define four cavities 62*a*, 62*b* (not shown), 64*a* and 64*b*. As seen in FIG. 8, bolts 66 may be extended through bolt passages 52 in reciprocal carrying ram 44 and threaded into reinforcing inserts 72 located in the rear of frame 70 in order to connect base member 54 to reciprocal carrying ram 44.

Referring to FIG. 7, a bushing assembly 72 is provided in the rear of base member 54 which cooperates with pin 56 projecting from face 50 of ram 44 to align base member 54 with ram 44. Bushing assembly 72 includes a replaceable bushing member 74 maintained within a reinforcing, hardened, metal, cup-shaped insert 76 by a key member 78. Key member 78 includes a flat portion 79 which mates with a corresponding flat portion 81 on the circumference of bushing member 74 to prevent rotation of bushing member 74. Key member 78 is removably connected to reinforcing insert 76 by bolt 80.

When mounted as shown in FIG. 7, key member 78 also prevents bushing member 74 from moving axially. In order to prevent axial movement of bushing member 74, key member 78 includes a lower edge 83 which engages and bears axially against a shoulder 85 formed by the rear edge of flat portion 81 in bushing member 74. The force of lower edge 83 against shoulder 85 thus forces bushing member 74 axially to the left in FIG. 7 which, in turn, forces the rear edge of a flange member 87 formed in the lower side of bushing member 74 against a shoulder 89 formed in the lower side of insert 76. As a result, once bolt 80 is threaded into insert 76, bushing member 74 cannot rotate or move axially. The head 82 of bolt 80 is substantially flush with the back face 84 of base member 54. Removal of bolt 80 from reinforcing insert 76 allows key member 78 to be removed which in turn allows bushing member 74 to be axially slid from within reinforcing insert 76 in order to be replaced.

Figure 9:
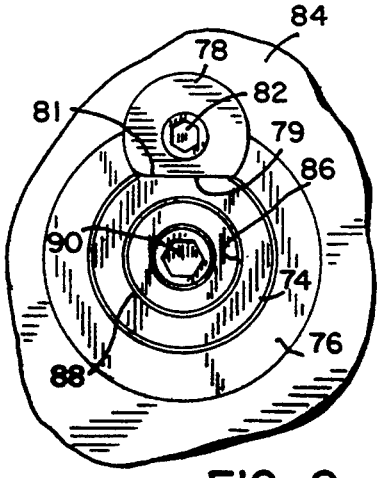
FIG. 9 is a rear view of the base member taken along line 9—9 of FIG. 7.
Figure 10:
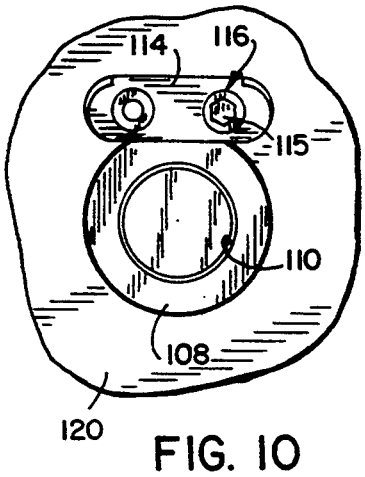
FIG. 10 is a rear view of the face plate taken along line 10—10 of FIG. 7.

Bushing member 74 defines a pin receipt cavity 86 for receipt of pin 56 of reciprocal carrying ram 44. As seen in FIG. 9, pin receipt cavity 86 in bushing assembly 72 allows access to bolt head 90 of bolt 92 by means of a screwdriver or the like. Bolt 92 extends through aperture 88 formed in the rear wall of insert 76 and passage 94 formed in frame 70 into a cavity 96 defined by the inner surface 98 of a reinforcement insert 100 located in the front face 101 of base member 54. A pin member 102 is threaded onto bolt 92 such that the rear of pin member 102 extends partially into cavity 96 to be supported circumferentially by insert 100 while its forward end projects from front face 101 of base member 54.

A bushing assembly 104 is also provided in face plate 106. The bushing assembly 104 includes a replaceable bushing member 108 received within a cavity 109 extending into face plate 106. The inner surface 110 of bushing member 108 defines a pin receipt cavity 112 for receipt of pin member 102 extending from base member 54. Bushing member 108 of bushing assembly 104 is maintained in face plate 106 by a key member 114. Key member 114 is connected to face plate 106 by a pair of screws 116. The head 118 of each screw 116 is substantially flush with the rear face 120 of face plate 106.

Key member 114 includes a flat portion 119 which mates with a corresponding flat portion 121 on the circumference of bushing member 108 to prevent rotation of bushing member 108. When mounted as shown in FIG. 7, key member 114 also prevents bushing member 108 from moving axially. In order to prevent axial movement of bushing member 108, key member 114 includes a lower edge 123 which engages and bears axially against the shoulder 125 formed by the rear edge of flat portion 121 in bushing member 108. The force of lower edge 123 against shoulder 125 thus forces bushing member 108 axially to the left in FIG. 7 which, in turn, forces the rear edge of flange member 127 formed in the lower side of bushing member 108 against the shoulder 129 formed in cavity 109 formed in face plate 106. As a result, when bolts 116, 118 are threaded into face plate 106, bushing member 108 cannot rotate or move axially. Removal of bolts 116, 118 from face plate 106 allows key member 114 to be removed which, in turn, allows bushing member 108 to be axially slid from within face plate 106 in order to be replaced.

Figure 5:
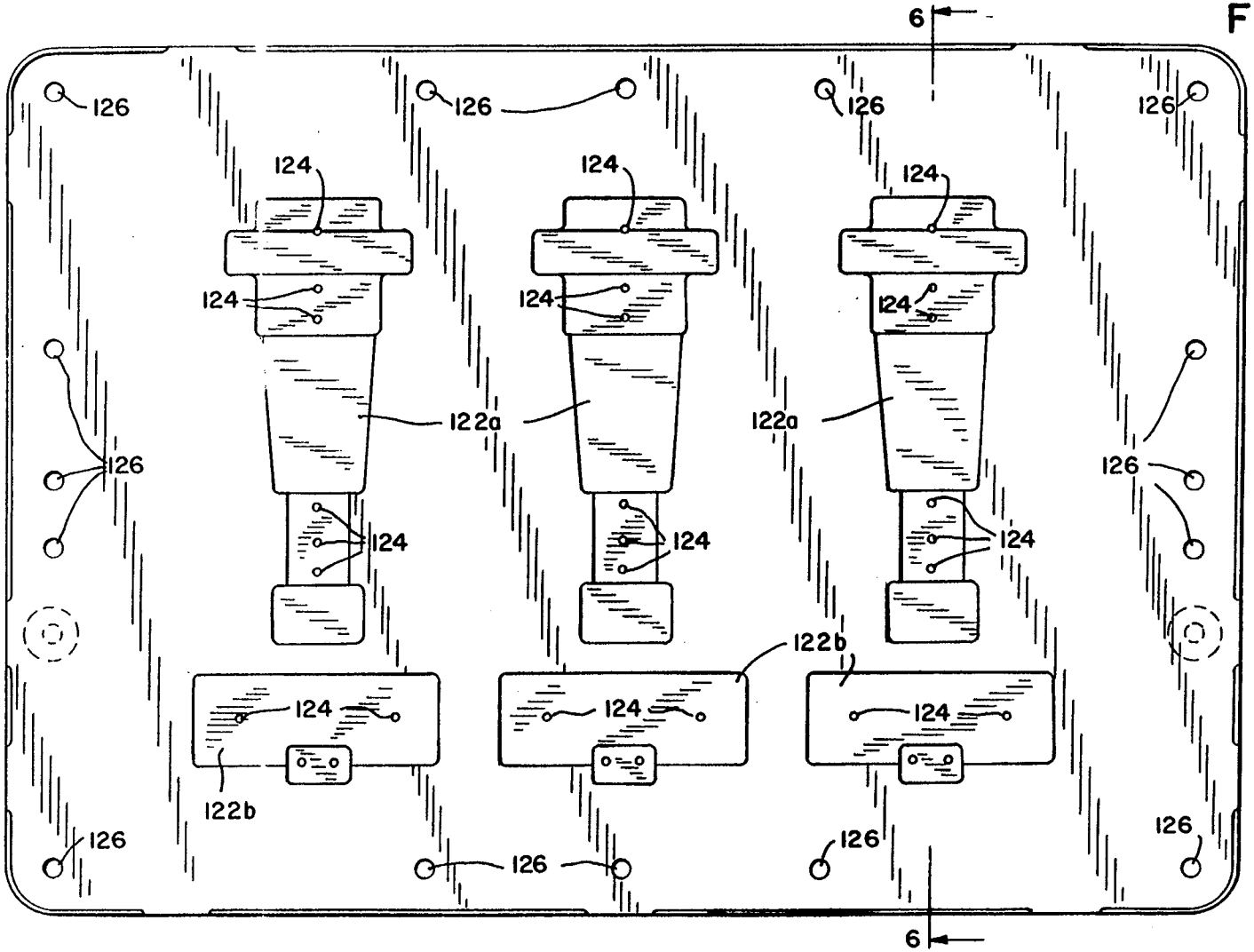
FIG. 5 is a front view of the core mask assembly of this invention.

Face plate 106 is provided with patterns 122*a*, 122*b* for receipt of cores 38*a*, 38*b*. As best seen in FIGS. 4 and 5, apertures 124 extend through patterns 122*a*, 122*b* so as to define an air flow passage from apertures 124, through cavities 62*a*, 62*b*, 64*a*, 64*b* and vacuum apertures 58, to the vacuum generating system. Additionally, bolt passages 126 are provided through face plate 106. Referring to FIG. 8, bolts 128 extend through bolt passages 126 and are threaded into reinforcing inserts 130 in base member 54 in order to removably mount the base member 54 to the face plate 106.

Figure 6:
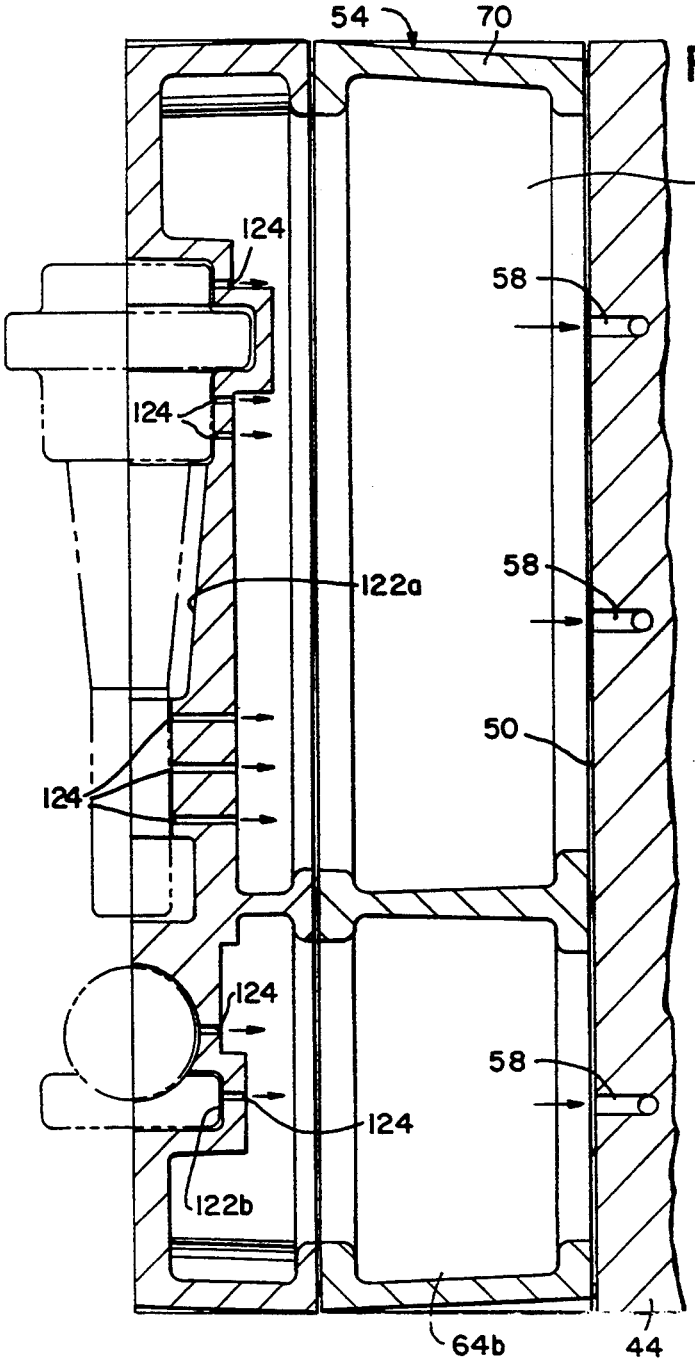
FIG. 6 is a sectional view, along line 6—6 of FIG. 5, showing a portion of the core mask assembly of this invention.

In operation, cores 38*a*, 38*b* are placed in patterns 122*a*, 122*b*. As seen in FIG. 6, the cores 38*a*, 38*b* are maintained in the patterns 122*a*, 122*b* by a vacuum generated by the vacuum generating system. The vacuum draws air through the air flow passage defined by apertures 124, cavities 62*a*, 62*b*, 64*a*, 64*b*, and apertures 58.

After mold section 14*b* is advanced from mold making machine 12 by the force of reciprocal ram 22, sand 18 is poured and compressed into the mold section 14*a* by reciprocal ram 22 and by upwardly pivotable gate 30. As pivotable gate 30 is raised, positioning cart 42 positions the core mask assembly in the conveyor path of mold section 14*a*. While in the path of mold section 14*a*, the reciprocal carrying ram 44 moves between a first position with pistons 48 retracted, FIG. 3, to a second position with pistons 48 extended such that cores 38*a*, 38*b* engage cavities 28*a*, 28*b* of mold section 14*b*.

When cores 38*a*, 38*b* engage cavities 28*a*, 28*b* of mold section 14*b*, the vacuum generating system disengages the vacuum generated through the air flow passage previously defined. Without a vacuum to hold cores 38*a*, 38*b* in patterns 122*a*, 122*b*, the cores 38*a*, 38*b* are released and thereby deposited in cavities 28*a*, 28*b*. Upon the deposit of cores 38*a*, 38*b* in cavities 28*a*, 28*b* of mold section 14*b*, pistons 48 retract thereby returning the reciprocal carrying ram 44 to the first position, as shown in FIG. 3. The positioning cart 42 then removes the core mask assembly 40 from the path of conveyor 16.

Mold section 14*a* is advanced from mold making machine 12 by the force of reciprocal ram 22 such that mold cavities 36*a*, 36*b* come in contact with previously formed mold cavities 28*a*, 28*b* having the deposited cores 38*a*, 38*b*. The cores 38*a*, 38*b* are thereby deposited in the internal cavities or patterns 37*a*, 37*b* formed by the joinder of the first and second cooperating mold sections. The mold then proceeds to a mold pouring station where the molten metal is dispensed.

Referring again to FIG. 4, in order to replace face plate 106, bolts 128 are removed from reinforcing inserts 130 so as to disconnect face plate 106 from base member 54. Face plate 106 remains adjacent to base member 54 by means of bushing assembly 104 riding on pin 102 extending from base member 54. This allows the operators to position themselves to remove the face plate 106 from the base member 54 without fear of the face plate 106 falling off the base member 54 when the bolts 128, FIG. 8, which are used to interconnect the face plate 106 and the base member 54 are removed.

In order to properly align a new face plate 106 on base member 54 so as to prevent shifted castings, the replacement face plate 106 is placed adjacent base member 54 such that bushing assembly 104 rides on pin member 102 extending from base member 54. Bolts 128 are inserted through bolt passages 126 and threaded into reinforcing inserts 130 in order to interconnect the new face plate 106 and the base member 54.

Due to the tremendous weight of face plate 106, pin member 102 tends to wear, and replacement is often necessary. To facilitate replacement, pin member 102 may be threaded off bolt member 92 and replaced. By replacing pin member 102, the user may insure accurate alignment between the face plate 106 and the base member 54 so as prevent shifted castings.

It can be seen from the above description that various alternative embodiments are possible without departing from the spirit of the invention.

I claim:

1. A core mask assembly for depositing a core within an internal cavity formed by the joinder of first and second cooperating mold sections, comprising:

a reciprocal carrying ram movable between a first core holding position and a second core depositing position;

a base member connectable to the reciprocal carrying ram;

a face plate connectable to the base member, the face plate including a pattern for receipt of the core;

means for removably mounting the face plate on the base member; and means for aligning the face plate on the base member, said means for aligning including a pin assembly removably connected to the base member, the pin assembly including a removable first pin member extending from the base member, and a bushing assembly extending into a first side of the face plate, the bushing assembly including a first bushing member received within the face plate and removably connected thereto wherein the first bushing member defines a first pin receipt cavity for receipt of the first pin member therein so as to align the face plate with respect to the base member.

2. The core mask assembly of claim 1 further comprising a means for positioning the core mask assembly between the first and the second cooperating mold sections.

3. The core mask assembly of claim 2 wherein the reciprocal carrying ram is interconnected to the core mask assembly positioning means by a piston, the piston movable between a first position wherein the reciprocal carrying ram is in the first core holding position and a second position wherein the reciprocal carrying ram is in the second core depositing position.

4. The core mask assembly of claim 1 wherein the pattern of the face plate includes a plurality of apertures extending therethrough.

5. The core mask assembly of claim 4 wherein the reciprocal carrying ram includes a plurality of apertures operatively connected to the vacuum generating system, the plurality of apertures in the pattern of the face plate and the apertures in the reciprocal carrying ram defining a suction flow path through the base member.

6. The core mask assembly of claim 1 further comprising a means for removably mounting the base member to the reciprocal carrying ram.

7. The core mask assembly of claim 6 wherein the means for mounting the base member to the reciprocal carrying ram comprises a plurality of bolts extending through the reciprocal carrying ram and threaded into the base member.

8. The core mask assembly of claim 6 further comprising means for aligning the base member on the reciprocal carrying ram.

9. The core mask assembly of claim 8 wherein the means for aligning the base member on the reciprocal carrying ram comprises:

a second pin member extending from the reciprocal carrying ram; and a pin receipt assembly removably connected to the base member for receipt of the second pin member.

10. The core mask assembly of claim 9 wherein the pin receipt assembly includes a second bushing member which defines a second pin receipt cavity for receipt of the second pin member, the second bushing member being removably received within the base member.

11. The core mask assembly of claim 10 further comprising a key member interconnected to the base member for maintaining the second bushing member therein.

12. The core mask assembly of claim 1 further comprising a vacuum generating system which maintains the core within the pattern, the vacuum generating system releasing the core when the reciprocal carrying ram is in the core depositing position.

13. A core mask for mounting on a reciprocal carrying ram of an assembly for depositing a core within an internal cavity of a mold, comprising:

a base member connectable to the reciprocal carrying ram;

a face place removably connectable to the base member, the face plate including a pattern for receipt of the core;

means for removably mounting the face plate on the base member; and means for aligning the face plate on the base member, said means for aligning including a first pin assembly removably connected to the base member, the first pin assembly including a removable first pin member extending from the base member, and a bushing assembly extending into a first side of the face plate, the bushing assembly including a bushing member received within the face plate and removably connected thereto wherein the bushing member defines a pin receipt cavity for receipt of the first pin member therein so as to align the face plate with respect to the base member.

14. The core mask of claim 13 wherein the reciprocal carrying ram is movable between a first core holding position and a second core depositing position.

15. The core mask of claim 14 further comprising a vacuum generating system for maintaining the core within the pattern, the vacuum generating system releasing the core when the reciprocal carrying ram is in the core depositing position.

16. The core mask of claim 15 wherein the pattern of the face plate includes a plurality of apertures extending therethrough and wherein the reciprocal carrying ram includes a plurality of apertures operatively connected to the vacuum generating system, the plurality of apertures in the pattern of the face plate and the apertures in the reciprocal carrying ram defining a suction flow path through the base member.

17. The core mask of claim 13 further comprising a means for interconnecting the base member and the reciprocal carrying ram.

18. The core mask of claim 17 wherein the means for interconnecting the base member and the reciprocal carrying ram includes a plurality of bolts extending through the reciprocal carrying ram and threaded into the base member.

19. The core mask of claim 17 further comprising means for aligning the base member on the reciprocal carrying ram.

20. The core mask of claim 19 wherein the means for aligning the base member on the reciprocal carrying ram comprises:

a second pin assembly interconnected to the reciprocal carrying ram, the second pin assembly including a second pin member extending from the reciprocal carrying ram; and a pin receipt assembly removably connected to the base member for receipt of the second pin member.

21. A device for depositing a core within an internal cavity formed by the joinder of first and second cooperating mold sections of a mold, comprising:

a core mask assembly including a base member and a face plate removably connectable to the base member, the face plate having a pattern for receipt of the core; and means for aligning the face plate on the base member, said means for aligning including a first pin assembly removably connected to the base member, the first pin assembly including a removable first pin member extending from the base member, and a bushing assembly extending into a first side of the face plate, the bushing assembly including a bushing member received within the face plate and removably connected thereto wherein the bushing member defines a pin receipt cavity for receipt of the first pin member therein so as to align the face plate with respect to the base member; and means for positioning the core mask assembly between the first and second cooperating mold sections.

22. The device of claim 21 wherein the core mask assembly further comprises a reciprocal carrying ram interconnected to the means for positioning the core mask assembly.

23. The device of claim 22 wherein the reciprocal carrying ram is interconnected to the means for positioning the core mask assembly by a piston, the piston movable between a first position wherein the reciprocal carrying ram is in the first core holding position and a second core depositing position wherein the reciprocal carrying ram is in the second core depositing position.

24. The device of claim 23 wherein the base member is connectable to the reciprocal carrying ram.

25. The device of claim 24 further comprising a vacuum generating system for maintaining the core within the pattern, the vacuum generating system releasing the core when the reciprocal carrying ram is in the core depositing position.

26. The device of claim 25 wherein the pattern of the face plate includes a plurality of apertures extending therethrough and the reciprocal carrying ram includes a plurality of apertures operatively connected to the vacuum generating system, the plurality of apertures and the pattern of the face plate and the apertures and the reciprocal carrying ram defining a suction flow path through the base member.

27. The device of claim 24 further comprising means for aligning the base member on the reciprocal carrying ram.

28. The device of claim 27 wherein the means for aligning the base member on the reciprocal carrying ram comprises:

a second pin assembly interconnected to the reciprocal carrying ram, the second pin assembly including a second pin member extending from the reciprocal carrying ram; and a pin receipt assembly removably connected to the base member for receipt of the second pin member.

* * * * *